US010934657B2

(12) United States Patent
Kamiyama et al.

(10) Patent No.: US 10,934,657 B2
(45) Date of Patent: Mar. 2, 2021

(54) WASHER DRYER MACHINE AND CONTROL METHOD

(71) Applicant: Panasonic Intellectual Property Management Co., Ltd., Osaka (JP)

(72) Inventors: Teruo Kamiyama, Osaka (JP); Mariko Nakaso, Shiga (JP); Kazuki Sakamoto, Shiga (JP); Hiroko Sugimoto, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 220 days.

(21) Appl. No.: 15/898,218

(22) Filed: Feb. 15, 2018

(65) Prior Publication Data

US 2018/0266034 A1 Sep. 20, 2018

(30) Foreign Application Priority Data

Mar. 16, 2017 (JP) ..... 2017-050844
Oct. 23, 2017 (JP) ..... 2017-204270

(51) Int. Cl.
*D06F 37/42* (2006.01)
*D06F 29/00* (2006.01)
(Continued)

(52) U.S. Cl.
CPC ..... *D06F 37/42* (2013.01); *D06F 25/00* (2013.01); *D06F 29/005* (2013.01); *D06F 33/00* (2013.01);
(Continued)

(58) Field of Classification Search
CPC ..... D06F 25/00; D06F 29/005; D06F 33/02; D06F 39/002; D06F 39/003; D06F 37/42; D06F 2202/10; D06F 2202/12; D06F 2204/06; D06F 2210/00; D06F 33/47; D06F 33/74; D06F 2103/46; D06F 2105/62
See application file for complete search history.

(56) References Cited

U.S. PATENT DOCUMENTS

2004/0061473 A1* 4/2004 Boys ..... H02P 1/26 318/778
2010/0270962 A1* 10/2010 Yoon ..... D06F 33/02 318/446

(Continued)

FOREIGN PATENT DOCUMENTS

JP 4-044799 2/1992
JP 2000-279686 10/2000

*Primary Examiner* — Joseph L. Perrin
(74) *Attorney, Agent, or Firm* — Greenblum & Bernstein, P.L.C.

(57) ABSTRACT

A washing machine includes: a drum that rotates with a washing or drying object contained in the drum; a motor that rotationally drives the drum; a controller that controls rotation of the motor; and an electric current measurer that measures an electric current value representing an electric current flowing in the motor. The controller controls the rotation of the motor to rotate the drum less than one turn, and in accordance with the measured electric current value, detects whether a foreign object that is different from the object and whose mass is greater than an expected mass of the object is inside the drum. In a case where the controller detects the foreign object, the controller stops operation of the washing machine.

16 Claims, 8 Drawing Sheets

(51) Int. Cl.

| | |
|---|---|
| ***D06F 25/00*** | (2006.01) |
| ***D06F 33/00*** | (2020.01) |
| ***D06F 34/18*** | (2020.01) |

(52) U.S. Cl.
CPC ..... *D06F 34/18* (2020.02); *D06F 2202/10* (2013.01); *D06F 2202/12* (2013.01); *D06F 2204/06* (2013.01); *D06F 2210/00* (2013.01)

(56) References Cited

U.S. PATENT DOCUMENTS

| | | | | |
|---|---|---|---|---|
| 2011/0241700 | A1* | 10/2011 | Ivanov | D06F 39/003 324/629 |
| 2011/0265271 | A1* | 11/2011 | Kim | D06F 37/42 8/137 |
| 2012/0104873 | A1* | 5/2012 | Astrauskas | D06F 37/42 307/326 |
| 2012/0159808 | A1* | 6/2012 | Nakamoto | D06F 25/00 34/565 |
| 2012/0235514 | A1* | 9/2012 | Astrauskas | D06F 33/02 307/326 |
| 2014/0236328 | A1* | 8/2014 | Kamon | D06F 33/02 700/90 |
| 2015/0051738 | A1* | 2/2015 | Lee | D06F 34/18 700/275 |
| 2015/0167226 | A1* | 6/2015 | Sieding | D06F 58/08 700/282 |
| 2015/0191859 | A1* | 7/2015 | Webster | D06F 37/42 68/12.06 |

* cited by examiner

WASHER DRYER MACHINE AND CONTROL METHOD

BACKGROUND

1. Technical Field

The present disclosure relates to a washer dryer machine and a control method.

2. Description of the Related Art

Generally, before starting the laundry, a washing machine measures the amount of laundry contained in a washing tub, and supplies water into the washing tub depending on the measured laundry amount. Furthermore, the washing machine depends on the measured laundry amount to appropriately perform a series of rinsing and draining processes as well. A generally-used method of measuring a laundry amount employs detection of the number of rotations or the rotation speed of the drum inside the washing tub. This laundry amount measurement method, however, has a problem that when a laundry amount is large, the rotation speed of the drum has to be increased to some extent in order to secure the measurement accuracy.

Among conventional laundry amount measuring methods is a method of measuring a laundry amount by changing the number of rotations of the drum for particular purposes. One conventional laundry amount measuring method is disclosed in the specification of Japanese Patent No. 3691282. For example, a washing machine disclosed in the specification of Japanese Patent No. 3691282 measures a laundry amount by rotating the drum at low rotation speed at first with noise inhibition taken into consideration. In a case where the washing machine determines that the laundry amount is small based on the laundry amount that is measured by rotating the drum at the low rotation speed, the washing machine terminates the laundry amount measurement because even the low rotation speed can guarantee sufficient measurement accuracy. On the other hand, in a case where the washing machine determines that the laundry amount is large, the washing machine again measures the laundry amount by increasing the rotation speed.

Meanwhile, a washing machine disclosed in Japanese Unexamined Patent Application Publication No. 4-44799, for example, measures a laundry amount and classifies it into one of four levels by rotating the drum 6 times in total in approximately 3 to 4 seconds before supplying water into the washing tub, and informs the user of a rough laundry amount.

SUMMARY

The above-mentioned conventional techniques, however, need to be improved to increase safety.

In one general aspect, the techniques disclosed here feature a washer dryer machine that washes or dries an object, including: a drum that rotates with the washing or drying object contained in the drum; a motor that rotationally drives the drum; a controller that controls rotation of the motor; and an electric current measurer that measures an electric current value representing an electric current flowing in the motor, in which the controller controls the rotation of the motor to rotate the drum less than one turn, and in accordance with the measured electric current value, detects whether a foreign object that is different from the object and whose mass is greater than an expected mass of the object is inside the drum, and in a case where the controller detects the foreign object, the controller stops operation of the washer dryer machine.

The present disclosure makes it possible for the machine, in place of the user that cannot or does not check the inside of the drum, to stop its operation in a case where the drum contains a foreign object. Accordingly, the present disclosure can improve the machine's safety.

These general and specific aspects may be implemented using a system, a method, and a computer program, and any combination of systems, methods, and computer programs.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

Figure 1:
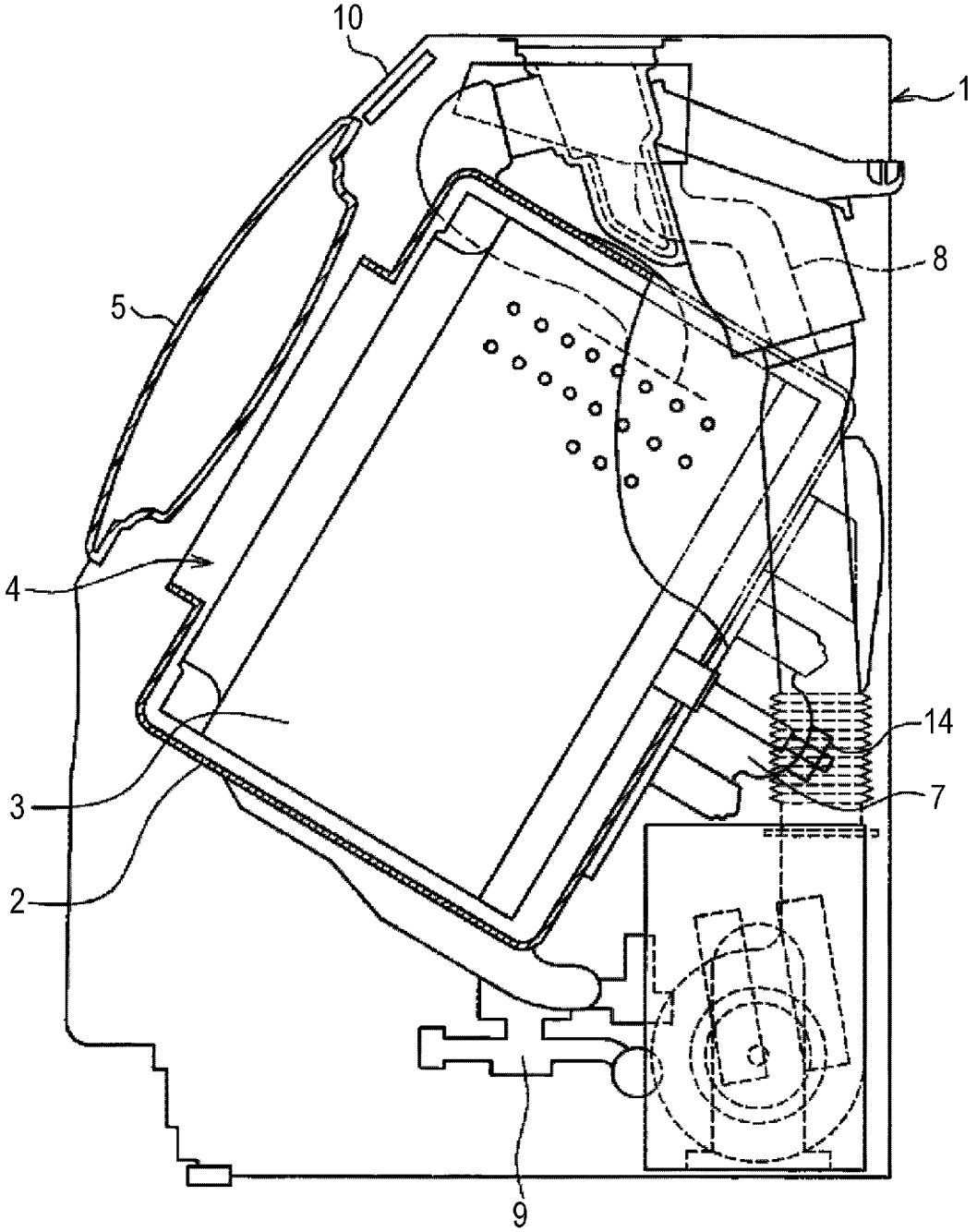
FIG. 1 is a cross-sectional view illustrating a schematic configuration of a washing machine according to a first embodiment of the present disclosure.

DETAILED DESCRIPTION (Underlying Knowledge Forming Basis of the Present Disclosure)

As discussed above, one conventional washing machine measures a laundry amount by rotating the drum at low rotation speed at first with noise inhibition taken into consideration. In a case where the washing machine determines that the laundry amount is small based on the laundry amount that is measured by rotating the drum at the low rotation speed, the washing machine terminates the laundry amount measurement because even the low rotation speed can guarantee sufficient measurement accuracy. On the other hand, in a case where the washing machine determines that the laundry amount is large, the washing machine again measures the laundry amount, but this time at an increased rotation speed.

The other conventional washing machine measures a laundry amount by rotating the drum 6 times in total in approximately 3 to 4 seconds and classifies it into one of four levels, before supplying water into the washing tub, and informs the user of a rough laundry amount.

These conventional washing machines have a common problem that, if a child enters inside the washing tub, the child will be involved in the laundry process. Meanwhile, there is an expectation that a remote control program will come into service in the future. The use of the remote control program will pose a risk that the user cannot check the inside of the washing tub when the user starts the laundry. A possible solution to this risk is to employ a weight sensor to detect a foreign object like a child. However, installation of the weight sensor into the washing machine would increase the cost of the washing machine.

The conventional laundry amount measurement method can measure the mass of clothes in the washing tub. Because the laundry amount is measured by rotating the drum in the washing tub, the washing tub is highly likely to rotate with a child inside if the child is there. According to the specification of Japanese Patent No. 3691282, for example, the drum rotates at a rotation speed of approximately 600 rpm even in the initial low rotation speed laundry amount measurement. If a child is inside the washing tub, there is likelihood that the child will get hurt. On the other hand, the laundry amount measurement method of Japanese Unexamined Patent Application Publication No. 4-44799 employs a smaller number of rotations and a shorter rotation time. However, the inside of the washing tub is not always safe, because the method requires the drum to rotate leftwards and rightwards 6 times in total.

A washer dryer machine that washes or dries an object according to an aspect of the present disclosure includes a drum that rotates with the washing or drying object contained in the drum; a motor that rotationally drives the drum; a controller that controls rotation of the motor; and an electric current measurement unit that measures an electric current value representing an electric current flowing in the motor, in which the controller controls the rotation of the motor to rotate the drum less than one turn, and in accordance with the electric current value measured by the electric current measurement unit, detects whether a foreign object that is different from the object and whose mass is greater than an expected mass of the object is inside the drum, and in a case where the controller detects the foreign object, the controller stops operation of the washer dryer machine.

This configuration works as follows. The drum rotates with the washing or drying object contained therein. The motor rotationally drives the drum. The controller controls the rotation of the motor. The electric current measurement unit measures the electric current value representing the electric current that flows in the motor. The rotation of the motor is controlled in order to rotate the drum less than one turn, and based on the electric current value measured by the electric current measurement unit, it is detected whether a foreign object that is different from the object and whose mass is greater than an expected mass of the object is inside the drum. In a case where a foreign object is detected, the operation of the washer dryer machine stops.

Thus, whether the drum contains a foreign object is determined by rotating the drum at the number of rotations that is as small as less than a half turn, and in the case where it is determined that the drum contains a foreign object, the operation is automatically stopped. Accordingly, even when the user cannot or does not check the inside of the drum (when the operation is started based on a reservation), the washer dryer machine can be operated safely. In addition, the foreign object can be detected without an addition component like a weight sensor.

Preferably, in the washer dryer machine, the controller controls the rotation of the motor to rotate the drum less than a half turn, and in accordance with the electric current value measured by the electric current measurement unit, detects whether the foreign object is inside the drum.

This configuration makes it possible to detect whether a foreign object is inside the drum more safely, since the rotation of the motor is controlled in order to rotate the drum less than a half turn.

Preferably, in the washer dryer machine, the controller controls the rotation of the motor to rotate the drum at a rotation speed that is slower than a rotation speed at which the drum rotates to detect the amount of the object, and in accordance with the electric current value measured by the electric current measurement unit, detects whether the foreign object is inside the drum.

This configuration makes it possible to detect whether a foreign object is inside the drum much more safely, since: the rotation of the motor is controlled in order to rotate the drum at the rotation speed that is slower that the rotation speed at which the drum rotates to detect the amount of the object; and based on the measured electric current value, it is detected whether a foreign object is inside the drum.

Preferably, in the washer dryer machine, in a case where the electric current value that is measured by the electric current measurement unit when the drum is rotated less than one turn is equal to or greater than a predetermined threshold, the controller detects the foreign object inside the drum.

This configuration detects a foreign object inside the drum, in the case where the electric current value measured by the electric current measurement unit when the drum is rotated less than one turn is equal to or greater than the predetermined threshold.

Thus, it is easily detected whether a foreign object is inside the drum by comparing the electric current value, measured by the electric current measurement unit when the drum is rotated less than one turn, with the predetermined threshold.

Preferably, in the washer dryer machine, the threshold is an electric current value corresponding to a weight that exceeds a maximum load of the object on which the washer dryer machine is capable of performing processing.

This configuration detects a foreign object inside the drum, in a case where the electric current value measured by the electric current measurement unit when the drum is rotated less than one turn is equal to or greater than the electric current value corresponding to the weight that exceeds the maximum load of the object on which the washer dryer machine is capable of performing processing.

Thus, it can be detected that the drum contains a foreign object, for example a child, whose weight exceeds the maximum load of the object the washer dryer machine is capable of processing.

Preferably, in the washer dryer machine, the washer dryer machine further includes a notifier that, in a case where the foreign object is detected, notifies that the drum contains the foreign object.

This configuration notifies that the drum contains a foreign object, in the case where the foreign object is detected there. Accordingly, the user can know that the drum contains the foreign object.

Preferably, in the washer dryer machine, the controller further detects an amount of the object in accordance with the electric current value measured by the electric current measurement unit, and detects whether the foreign object is inside the drum before detecting the amount of the object.

This configuration detects the amount of the object based on the electric current value measured by the electric current measurement unit. This configuration detects whether a foreign object is inside the drum, before detecting the amount of the object.

Thus, before the amount of the object is detected, it can be detected whether a foreign object different from the object is inside. Accordingly, the amount of the object can be detected safely.

Preferably, in the washer dryer machine, the washer dryer machine is a washing machine, the washer dryer machine further includes a communication unit that, from an external device connected to the washer dryer machine via a network, receives a laundry reservation instruction to reserve time at which to make the washer dryer machine start washing the object, or a laundry start instruction to make the washer dryer machine start washing the object, and in a case where the communication unit receives the laundry reservation instruction or the laundry start instruction, the controller detects whether the foreign object is inside the drum before the time at which to make the washer dryer machine start washing the object is reserved, or before the washer dryer machine starts washing the object.

This configuration works as follows. The washer dryer machine is a washing machine. The laundry reservation instruction to reserve the time at which to make the washer dryer machine start washing the object, or the laundry start instruction to make the washer dryer machine start washing the object is received from the external device connected to the washer dryer machine via the network. In the case where the laundry reservation instruction or the laundry start instruction is received, whether a foreign object is inside the drum is detected before the time at which to make the washer dryer machine start washing the object is reserved, or before the washer dryer machine starts washing the object.

Thus, in the case where the user remotely controls the washer dryer machine, whether a foreign object is inside the drum can be detected before the time at which to make the washer dryer machine start washing the object is reserved, or before the washer dryer machine starts washing the object.

Preferably, in the washer dryer machine, in a case where the foreign object is detected, the communication unit sends the external device notification information notifying that the drum contains the foreign object.

This configuration sends the external device the notification information notifying that the drum contains a foreign object, in the case where the foreign object is detected therein.

Thus, the user carrying the external device can be notified that the foreign object is inside the drum.

Preferably, in the washer dryer machine, after sending the external device the notification information, the communication unit receives from the external device a foreign object detection instruction to make the controller again detect whether the foreign object is inside the drum, and in a case where the communication unit receives the foreign object detection instruction, the controller controls the rotation of the motor to rotate the drum less than one turn, and in accordance with the electric current value measured by the electric current measurement unit, detects again whether the foreign object is inside the drum.

This configuration receives from the external device the foreign object detection instruction to detect again whether a foreign object is inside the drum, after sending the external device the notification information. When receiving the foreign object detection instruction, this configuration controls the rotation of the motor in order to rotate the drum less than one turn, and based on the measured electric current value, detects again whether the foreign object is inside the drum.

Thus, it is possible to prevent a foreign object from being wrongly detected, since it is detected again whether a foreign object is inside the drum.

Preferably, in the washer dryer machine, the washer dryer machine is a washing machine, the controller sets a remote control mode to allow an external device connected to the washer dryer machine via a network to remotely control the washer dryer machine, the washing machine further includes a communication unit that, from the external device, receives a laundry reservation instruction to reserve time at which to make the washer dryer machine start washing the object, or a laundry start instruction to make the washer dryer machine start washing the object, and in a case where the remote control mode is set, the controller controls the rotation of the motor in order to rotate the drum less than one turn, obtains the electric current value measured by the electric current measurement unit as a first electric current value, and stores the obtained first electric current value into a storage, and in a case where the communication unit receives the laundry reservation instruction or the laundry start instruction, before the time at which to make the washer dryer machine start washing the object is reserved, or before the washer dryer machine starts washing the object, the controller controls the rotation of the motor in order to rotate the drum less than one turn, obtains the electric current value measured by the electric current measurement unit as a second electric current value, calculates a difference between the obtained second electric current value and the first electric current value stored in the storage, determines whether the calculated difference is not greater than a predetermined threshold, and detects the foreign object inside the drum in a case where the controller determines that the difference is greater than the predetermined threshold.

This configuration works as follows. The washer dryer machine is a washing machine. The remote control mode to allow the external device connected to the washer dryer machine via the network to remotely control the washer dryer machine is set in the washer dryer machine. The laundry reservation instruction to reserve the time at which to make the washer dryer machine start washing the object, the laundry start instruction to make the washer dryer machine start washing the object is received from the external device. In the case where the washer dryer machine is set in the remote control mode, the rotation of the motor is controlled in order to rotate the drum less than one turn. The electric current value measured by the electric current measurement unit is obtained as the first electric current value. The obtained first electric current value is stored into the storage. In the case where the laundry reservation instruction or the laundry start instruction is received, before the time at which to make the washer dryer machine start washing the object is reserved, or before the washer dryer machine starts washing the object, the rotation of the motor is controlled in order to rotate the drum less than one turn. The electric current value measured by the electric current measurement unit is obtained as the second electric current value. The difference is calculated between the obtained second electric current value and the first electric current value stored in the storage. It is determined whether the calculated difference is not greater than the predetermined threshold. In the case where it is determined that the difference is greater than the predetermined threshold, the foreign object inside the drum is detected.

Thus, a foreign object inside the drum is detected in the case where the difference between the first electric current value measured by rotating the drum less than one turn when the remote control mode to allow the external device to perform the remote control is set and the second electric current value measured by rotating the drum less than one turn when the laundry reservation instruction or the laundry start instruction is received from the external device is greater than the threshold. Accordingly, the foreign object inside the drum can be detected with higher accuracy.

Preferably, in the washer dryer machine, the drum has a rotation center axis extending in a horizontal direction, or a rotation center axis extending in an inclined direction that is inclined with respect to the horizontal direction.

The configuration is capable of detecting whether a foreign object is inside the drum that has the rotation center axis extending in the horizontal direction, or the rotation center axis extending in the inclined direction that is inclined with respect to the horizontal direction.

A method of controlling a washer dryer machine according to another aspect of the present disclosure that washes or dries an object includes a drum that rotates with the washing or drying object contained in the drum; a motor that rotationally drives the drum; a controller that controls rotation of the motor; and an electric current measurement unit that measures an electric current value representing an electric current flowing in the motor, the method including: controlling the rotation of the motor in order to rotate the drum less than one turn, and in accordance with the electric current value measured by the electric current measurement unit, detecting whether a foreign object that is different from the object and whose mass is greater than an expected mass of the object is inside the drum, and stopping operation of the washer dryer machine in a case where the foreign object is detected.

This configuration works as follows. The drum rotates with the washing or drying object contained therein. The motor rotationally drives the drum. The controller controls the rotation of the motor. The electric current measurement unit measures the electric current value representing the electric current that flowing in the motor. The rotation of the motor controlled in order to rotate the drum less than one turn. Based on the electric current value measured by the electric current measurement unit, it is detected whether a foreign object that is different from the object and whose mass is greater than the expected mass of the object is inside the drum. In the case where the foreign object is detected, the operation of the washer dryer machine is stopped.

Thus, whether the drum contains a foreign object is determined by rotating the drum at the number of rotations that is as small as less than a half turn, and in the case where it is determined that the drum contains a foreign object, the operation is automatically stopped. Accordingly, even when the user cannot or does not check the inside of the drum (when the operation is started based on a reservation), the user can operate the washer dryer machine safely. In addition, the foreign object can be detected without an addition configuration like a weight sensor.

Descriptions will be hereinbelow provided for embodiments of the present disclosure by referring to the drawings. It should be noted that the below-described embodiments are examples of embodiments of the present disclosure, and do not limit the technical scope of the present disclosure.

First Embodiment

FIG. 1 is a cross-sectional view illustrating a schematic configuration of a washing machine according to a first embodiment of the present disclosure. The washing machine 1 is a drum type washing machine which is an example of a washer dryer machine.

A suspension structure including a vibration-proof structure hangingly supports a washing tub 2 inside the main body of the washing machine 1. Inside the washing tub 2, a drum 3 formed in the shape of a cylinder with a bottom is supported in a way that an axial direction of the drum 3 is inclined lower toward the rear from the front. A laundry loading/unloading opening 4 that continues to an opening end of the drum 3 is formed in the front of the laundry tub 2. An upward-facing inclined surface in the front of the main body of the washing machine 1 is provided with an opening portion. The opening portion is openably closed by a door 5. Laundry can be loaded into and unloaded from the drum 3 through the laundry loading/unloading opening 4 by opening and closing the door 5.

The drum 3 rotates with a washing or drying object (for example, clothes) contained inside the drum 3. The drum 3 has a rotation center axis extending in an inclination direction that is inclined with respect to the horizontal direction. A motor 7 mounted behind the washing tub 2 rotationally drives the drum 3 in forward and reverse directions. The washing tub 2 is elastically supported in the main body of the washing machine with the drum 3 rotatably contained in the washing tub 2. In addition, a water supply pipe 8 and a drain pipe 9 are connected to the washing tub 2. Water is supplied into and drained from the washing tube 2 by controlling a water supply valve and a drain valve. Incidentally, the drum 3 may have the rotation center axis extending in the horizontal direction or in the vertical direction. Furthermore, the washing or drying object may be cloth or leather products rather than clothes.

A laundry process is started as follows. The door 5 is opened, and laundry and detergent are put into the drum 3. Then, a control panel 10 provided in the front upper part of the main body of the washing machine 1 is manipulated. Thereby, the washing machine 1 starts its operation. A predetermined quantity of water is poured into the washing tub 2 through the water supply pipe 8, and the drum 3 is rotationally driven by the motor 7. Once the laundry process is started, the motor 7 rotationally drives the drum 3. While the drum 3 is rotating, agitation operations are repeated in which the laundry contained in the drum 3 is lifted in the rotation direction by the agitation paddles provided to the inner circumferential wall of the drum 3, and is dropped from an appropriate height position to which the laundry is lifted. Thus, a beat-washing effect is exerted on the laundry, and the laundry is washed.

After a predetermined washing time, the dirty laundry liquid is drained through the drain pipe 9, and the laundry liquid contained in the laundry is removed from the laundry by spinning operation of rotating the drum 3 at high speed. Thereafter, a rinsing process is performed by pouring water into the washing tub 2 through the water supply pipe 8. During this rinsing process, too, agitation operations are repeated in which the laundry contained in the drum 3 is lifted by the agitation paddles in response to the rotation of the drum 3, and is dropped.

Furthermore, a rotation detector 14 is provided inside the motor 7. The rotation detector 14 is made from things such as a position detecting device that detects the position of the rotor of the motor 7, and detects how the motor 7 rotates. The rotation detector 14 detects the number of rotations of the rotor of the motor 7. The number of rotations of the rotor of the motor 7 means the number of rotations of the drum 3.

The thus-configured drum type washing machine detects the amount of laundry including clothes that is put into the drum 3, and determines the washing time, the rinsing time, the spinning time and the like depending on the detected laundry amount.

Figure 2:
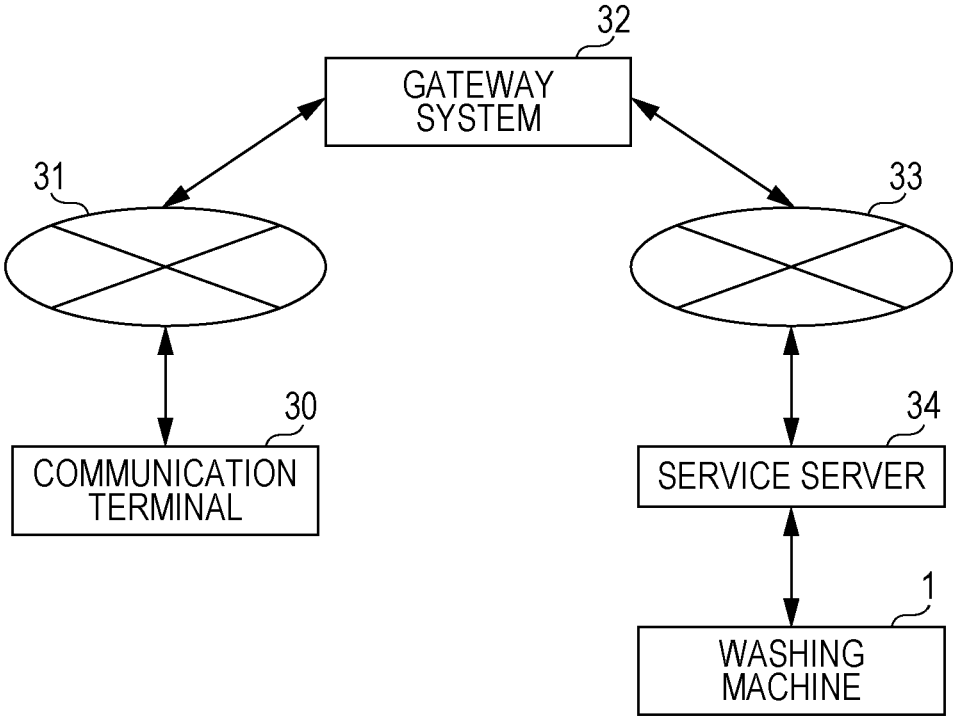
FIG. 2 is a schematic configuration diagram of a remote control system of the washing machine according to the first embodiment of the present disclosure.

FIG. 2 is a diagram illustrating a schematic configuration of a remote control system of the washing machine according to the first embodiment of the present disclosure. The remote control system includes: the washing machine 1 to be remotely controlled; and a communication terminal 30 that the user of the washing machine 1 owns. The washing machine 1 is connected to a service server 34.

The service server 34 sends and receives information to and from various information terminal devices that are connected to the Internet 33.

The Internet 33 and the public telephone network 31 built by telephone companies are connected to each other through a gateway system 32. The public telephone network 31 includes a wireless telephone network. The communication terminal 30 can be connected to the public telephone network 31. The communication terminal 30 can be communicably connected to the washing machine 1 through the public telephone network 31, the gateway system 32, the Internet 33, and the service server 34.

The communication terminal 30 is, for example, a cellular phone, a smart phone, a tablet computer or a personal computer. The communication terminal 30 remotely controls the washing machine 1 while sending and receiving various pieces of information to and from the washing machine 1. The communication terminal 30 is an example of an external device.

Figure 3:
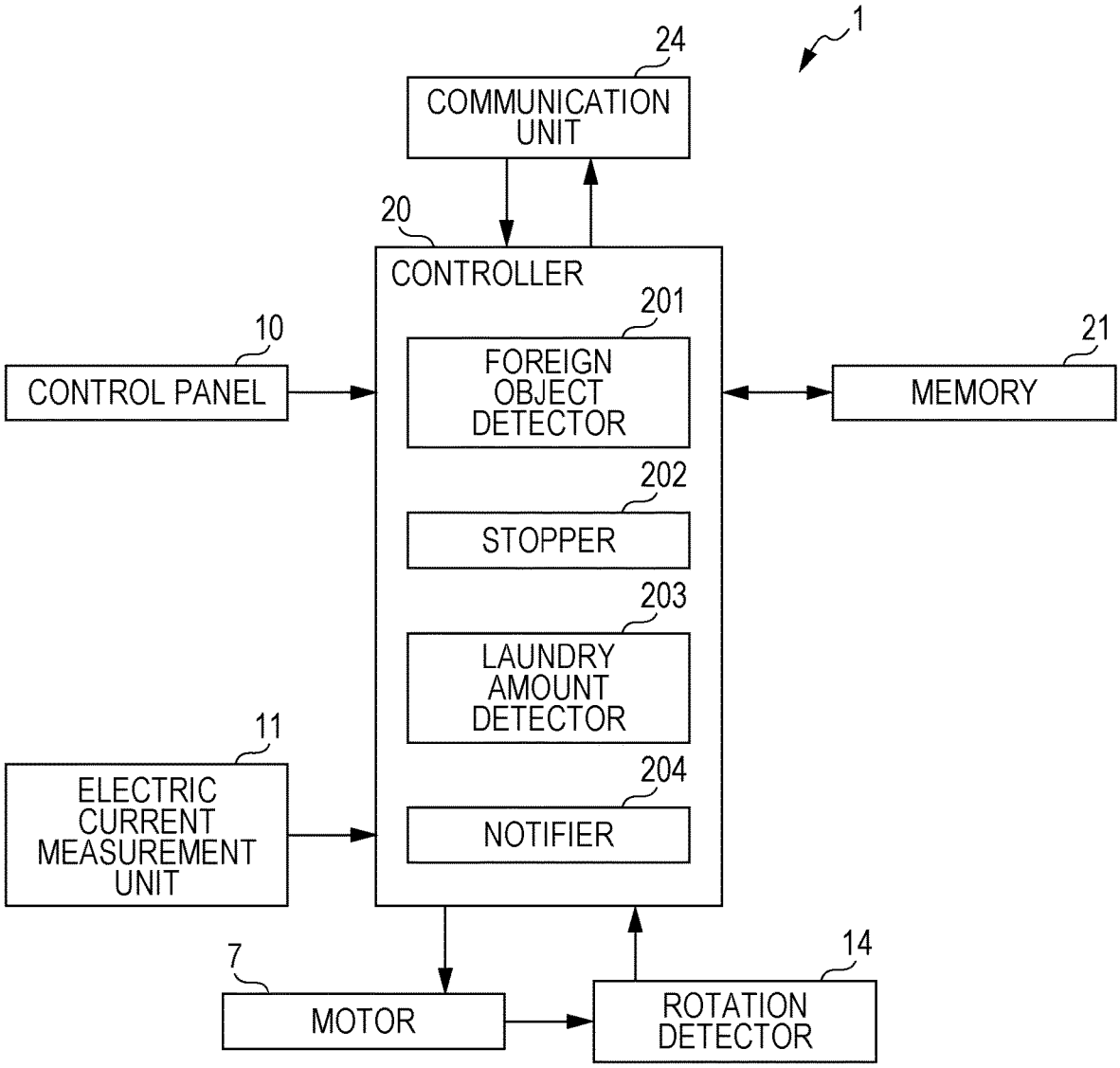
FIG. 3 is a block diagram illustrating a configuration of the washing machine according to the first embodiment of the present disclosure.

FIG. 3 is a block diagram illustrating a configuration of the washing machine according to the first embodiment of the present disclosure. It should be noted that FIG. 3 illustrates only the configuration related to a foreign object detection and a laundry amount detection. In addition, the washing machine 1 is an example of the washer dryer machine.

The washing machine 1 includes the motor 7, the control panel 10, an electric current measurement unit 11, the rotation detector 14, a controller 20, a memory 21 and a communication unit 24.

The controller 20 is, for example, a microcomputer-based central processing unit (CPU). The controller 20 controls the rotation of the motor 7. The memory 21 stores a control program or data that are used to control all the operation of the washing machine. The electric current measurement unit 11 measures an electric current value representing the electric current that flows in the motor 7. In addition, the controller 20 is connected to the motor 7, the control panel 10, the electric current measurement unit 11, the rotation detector 14, the memory 21 and the communication unit 24.

The controller 20 interprets instructions that are inputted using the control panel 10. For example, the laundry amount is measured as follows. The controller 20 makes the motor 7 rotate the drum 3. Meanwhile, the controller 20 is connected to the rotation detector 14 that detects the rotation speed or the number of rotations of the motor 7. The controller 20 stores the result of the detection by the rotation detector 14 into the memory 21. Furthermore, the controller 20 rotates the motor 7 by controlling the torque current. During the rotation of the motor 7, the electric current measurement unit 11 measures a torque current value representing the torque current that is used to rotate the motor 7. The controller 20 stores the result of the detection by the electric current measurement unit 11 into the memory 21. Incidentally, the control panel 10 includes: various control switches for controlling the washing machine; and a display section for displaying laundry or drying operation programs, an execution or left time of each program, and the like. The execution time of each program is calculated based on the amount of laundry in the washing tub 2.

The controller 20 includes a foreign object detector 201, a stopper 202, a laundry amount detector 203 and a notifier 204.

The foreign object detector 201 controls the rotation of the motor 7 in order to rotate the drum 3 less than one turn, and based on an electric current value measured by the electric current measurement unit 11, detects whether a foreign object that is different from the object (clothes) and whose mass is greater than an expected mass of the object is inside the drum 3. In this respect, the foreign object means a child, an infant, or the like, for example. Furthermore, the foreign object detector 201 controls the rotation of the motor 7 in order to rotate the drum 3 less than a half turn, and based on an electric current value measured by the electric current measurement unit 11, detects whether a foreign object is inside the drum 3.

The foreign object detector 201 controls the rotation of the motor 7 in order to rotate the drum 3 less than one turn, and based on the electric current value measured by the electric current measurement unit 11, determines whether a foreign object that is different from the object (clothes) and whose mass is greater than an expected mass of the object is inside the drum 3. In this respect, the foreign object means a child, an infant, or the like, for example. The foreign object detector 201 controls the rotation of the motor 7 in order to rotate the drum 3 less than a half turn, and based on the electric current value measured by the electric current measurement unit 11, determines whether a foreign object is inside the drum 3.

The foreign object detector 201 detects a foreign object in the drum 3 by detecting a weight that exceeds the maximum load of clothes the washing machine 1 is capable of processing. To put it specifically, in a case where an electric current value that is measured by the electric current measurement unit 11 while the drum 3 is being rotated less than one turn is equal to or greater than a predetermined threshold, the foreign object detector 201 detects a foreign object in the drum 3. In this respect, the predetermined threshold is an electric current value corresponding to the weight that exceeds the maximum load of clothes the washing machine 1 is capable of processing.

In a case where the foreign object detector 201 detects a foreign object, the stopper 202 stops the operation of the washing machine 1, and stops the rotation of the drum 3. In the case where the foreign object detector 201 determines that the drum 3 contains a foreign object, the stopper 202 stops the operation of the washing machine 1, and stops the rotation of the drum 3.

The laundry amount detector 230 detects a laundry amount (an amount of clothes) based on an electric current value measured by the electric current measurement unit 11. Incidentally, the foreign object detector 201 detects whether the drum 3 contains a foreign object, before the laundry amount detector 230 detects a laundry amount (an amount of clothes).

In a case where the foreign object detector 201 detects a foreign object, the notifier 204 notifies that the drum 3 contains the foreign object.

The washing machine 1 is connected to the service server 34 via the communication unit 24. The communication unit 24 receives instruction information from the external communication terminal 30, and outputs the received instruction information to the controller 20. In addition, the communication unit 24 receives a control result from the controller 20, and sends the control result to the communication terminal 30. In the case where the foreign object detector 201 detects a foreign object, the communication unit 24 sends the communication terminal 30 notification information for notifying that the drum 3 contains the foreign object.

The communication unit 24 is designed to make communications using Wi-Fi (registered trademark) for the purpose of employing the remote control system, which will be discussed later. In the case of an in-house remote control rather than the remote control from outside the house like in the later-discussed remote control system, however, the communication unit 24 may control communications using Bluetooth (registered trademark) instead of Wi-Fi.

Furthermore, from the communication terminal 30 connected to the washing machine 1 via the network, the communication unit 24 receives a laundry reservation instruction to reserve time at which to make the washing machine 1 start washing clothes, or a laundry start instruction to make the washing machine 1 start washing clothes. In a case where the communication unit 24 receives the laundry reservation instruction or the laundry start instruction, the foreign object detector 201 detects whether a foreign object is inside the drum 3 before the time at which to make the washing machine start washing the clothes is reserved, before the washing machine starts washing the clothes.

Next, descriptions will be provided for a foreign object detection process and a laundry amount detection process to be performed by the washing machine 1 according to the first embodiment.

To begin with, an example of the laundry amount detection process of the first embodiment will be discussed before the foreign object detection process of the first embodiment. The laundry amount detection process of the first embodiment is the same as the generally-used laundry amount detection process.

Figure 4:
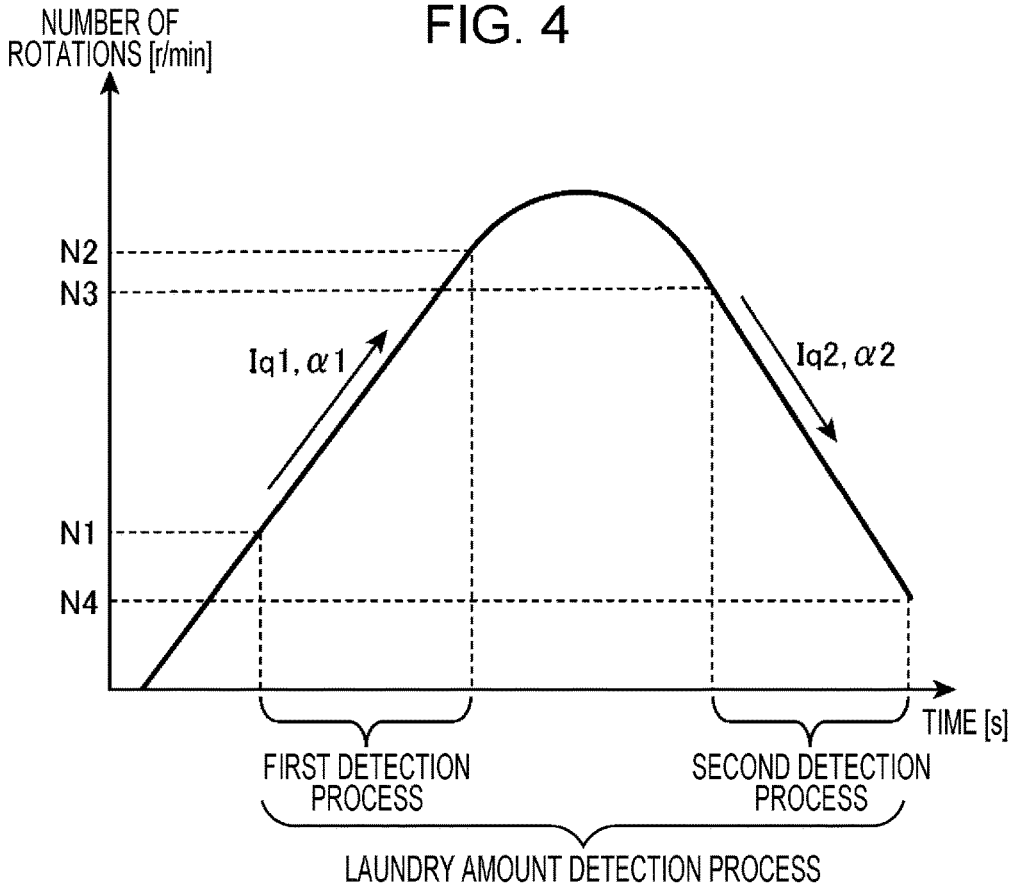
FIG. 4 is a diagram for explaining how a laundry amount detecting process used for the washing machine works in the first embodiment.

FIG. 4 is a diagram for explaining how the laundry amount detection process employed for the washing machine works in the first embodiment. Incidentally, in FIG. 4, the vertical axis represents the number of rotations (r/min), and the horizontal axis represents time (s).

In the laundry amount detecting process, first of all, the laundry amount detector 203 activates the motor 7. The rotation detector 14 outputs the detection result to the laundry amount detector 203. The laundry amount detecting process includes a first detection process and a second detection process.

In the first detection process, the laundry amount detector 203 makes the motor 7 accelerate the drum 3 at a certain angular acceleration $\alpha 1$ by controlling a torque-contributing current component Iq, and thus increases the number of rotations of the drum 3 from N1 to N2, thereby measuring an acceleration current value Iq1 representing an acceleration current that flows in the motor 7.

In the second detection process following the first detection process, the laundry amount detector 203 makes the motor 7 decelerate the drum 3 at a certain angular acceleration $\alpha 2$, and thus decreases the number of rotations of the drum 3 from N3 to N4, thereby measuring a deceleration current value Iq2 representing a deceleration current that flows in the motor 7. The acceleration current value Iq1 and the deceleration current value Iq2 that flow in the motor 7 become larger as the laundry amount becomes larger. They become smaller as the laundry amount becomes smaller. The laundry amount detector 203 detects a laundry amount using a fact that the electric current value representing the electric current that flows in the motor 7 is in proportion to the laundry amount. To put it specifically, the memory 21 beforehand stores a table in which deference values between acceleration current values Iq1 and deceleration current values Iq2 are associated with laundry amounts. Using this table, the laundry amount detector 203 detects a laundry amount based on the difference value between the acceleration current value Iq1 and the deceleration current value Iq2.

Even in a case where laundry clothes in the drum 3 increases or decreases in amount due to the laundry amount detection process, the laundry amount detector 203 flexibly detects the laundry amount, and makes it possible to determine which laundry program is appropriate to the measured laundry amount. Incidentally, the accuracy in the laundry amount measurement is sufficient as long as an appropriate laundry program can be selected based on the measured laundry amount.

Next, descriptions will be provided for the foreign object detection process of the first embodiment.

The foreign object detection process to be performed by the washing machine of the first embodiment is characterized in that, even if a child is inside the drum 3, it is safely detected before the laundry amount detection process that the drum 3 contains the child.

An example of the foreign object detection process, the weight of a foreign object in the drum 3 is measured by rotating the drum 3 at the number of rotations that is less than a half turn.

Figure 5:
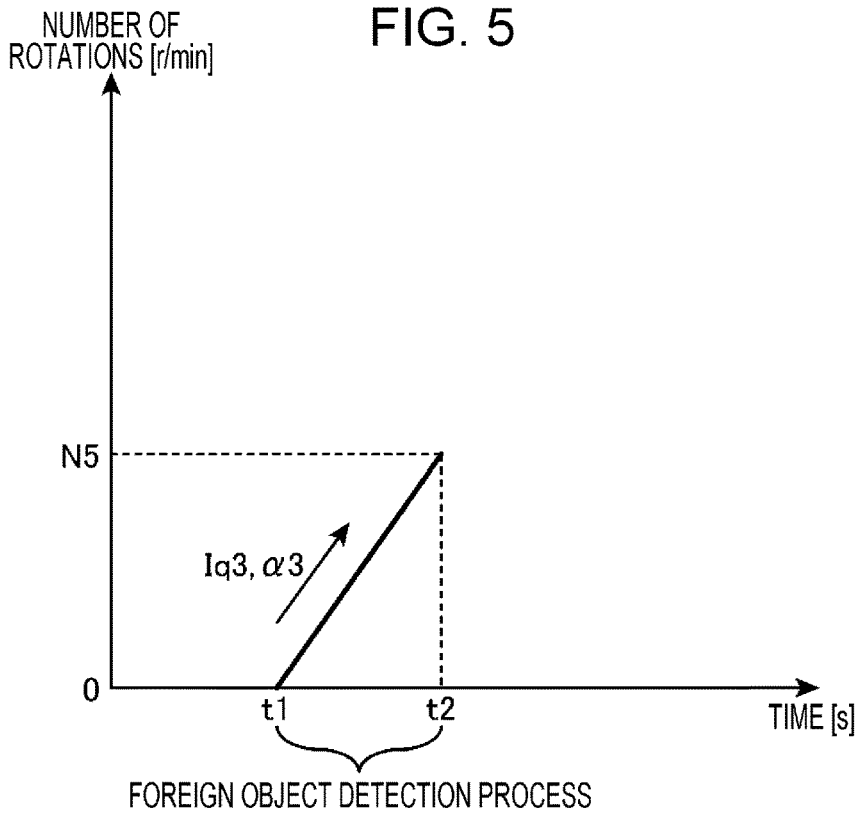
FIG. 5 is a diagram for explaining how a foreign object detecting process used for the washing machine works in the first embodiment.

FIG. 5 is a diagram for explaining how the foreign object detection process employed for the washing machine works in the first embodiment. Incidentally, in FIG. 5, the vertical axis represents the number of rotations (r/min), and the horizontal axis represents time (s).

In the foreign object detection process, first of all, the foreign object detector 201 activated the motor 7, and the rotation detector 14 outputs the detection result to the foreign object detector 201.

In the foreign object detection process, the foreign object detector 201 makes the motor 7 accelerate the drum 3 at a certain angular acceleration $\alpha 3$, and thus increases the number of rotations of the drum 3 from zero to N5 that is less than a half turn, thereby measuring an acceleration current value Iq3 representing an acceleration current that flows in the motor 7. Incidentally, whether the drum 3 completes a rotation of less than a half turn can be determined based on a time length from time t1 to time t2, and information on the angular acceleration $\alpha 3$ and the number of rotations N5 that can be detected by the rotation detector 14. After the drum 3 completes a rotation of less than a half turn, the foreign object detector 201 makes the motor 7 stop the rotation of the drum 3. On this occasion, the foreign object detector 201 determines whether an electric current value equal to or greater than a predetermined value is measured. In a case where the electric current value equal to or greater than the predetermined value is measured, the foreign object detector 201 detects that the drum 3 contains an object that is as heavy as a child, and thereby temporarily stops the operation of the washing machine 1.

After the operation of the washing machine 1 is temporarily stopped, the notifier 204 notifies the user that there is possibility that a child is inside the drum 3. As a notification method, the notifier 204 may be configured to send information that there is possibility that a child is inside the drum 3 to the communication terminal 30 connected to the washing machine 1 via the network. Otherwise, the notifier 204 may be configured to perform the notification by making a speaker (not illustrated) of the washing machine 1 produce a sound such as a buzzing noise, or by displaying the message or icon on the control panel 10.

Next, descriptions will be provided for the foreign object detection process of a modification of the first embodiment.

A foreign object detection process of the modification of the first embodiment may be such that whether a child is inside the drum 3 is detected by rotating the drum 3 at a very slow rotation speed that is slow enough not to hurt a child even if the child is inside the drum 3.

Figure 6:
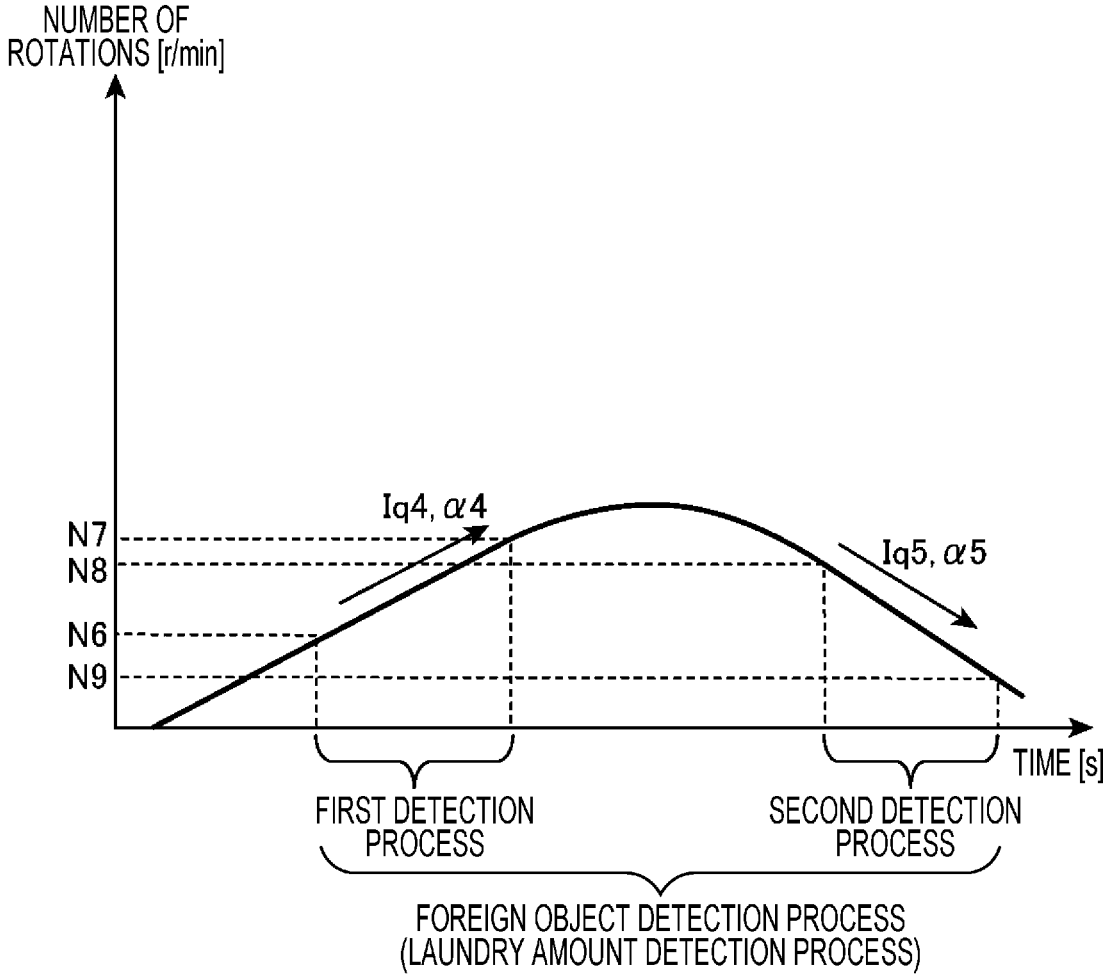
FIG. 6 is a diagram for explaining how a foreign object detecting process used for the washing machine works in a modification of the first embodiment.

FIG. 6 is a diagram for explaining how the foreign object detection process used for the washing machine works in the modification of the first embodiment. It should be noted that the foreign object detection process of the modification of the first embodiment is capable of detecting not only whether the drum 3 contains a foreign object, but also a laundry amount. For this reason, the foreign object detection process of the modification of the first embodiment functions as the laundry amount detection process as well.

In the foreign object detection process, first of all, the foreign object detector 201 activates the motor 7, and the rotation detector 14 outputs the detection result to the foreign object detector 201. During the foreign object detection process, the foreign object detector 201 controls the rotation of the motor 7 in order to rotate the drum 3 at a rotation speed that is lower than the rotation speed at which the drum 3 rotates to detect the laundry amount (the amount of clothes). The foreign object detection process includes a first detection process and a second detection process.

In the first detection process, the foreign object detector 201 makes the motor 7 accelerate the drum 3 at a certain angular acceleration $\alpha 4$ by controlling a torque-contributing current component Iq, and thus increases the number of rotations of the drum 3 from N6 to N7, thereby measuring an acceleration current value Iq4 representing an acceleration current that flows in the motor 7.

In the second detection process following the first detection process, the foreign object detector 201 makes the motor 7 decelerate the drum 3 at a certain angular acceleration $\alpha 5$, and thus decreases the number of rotations from N8 to N9, thereby measuring a deceleration current value Iq5 representing a deceleration current that flows in the motor 7. It is required that the angular acceleration $\alpha 4$, $\alpha 5$ for the foreign object detection process be less than the angular acceleration $\alpha 1$, $\alpha 2$ for the ordinary laundry amount detection. In addition, it is required that the number of rotations of the drum 3 that is rotating at a very slow rotation speed be small (for example, 10 rpm) enough not to hurt a child even if the child is inside the drum 3. In other words, it is preferable that the numbers of rotations N6, N7, N8, N9 be equal to or less than 10 rpm.

Otherwise, the numbers of rotations N6, N7, N8, N9 may be equal to or less than one sixth of the maximum number of rotations of the drum 3. For example, in a case where the maximum number of rotations of the drum 3 is 180 rpm, the numbers of rotations N6, N7, N8, N9 may be equal to or less than 30 rpm.

After the electric current measurement unit 11 measures the acceleration current value Iq4 and the deceleration current value Iq5, the foreign object detector 201 determines whether the difference value between the acceleration current value Iq4 and the deceleration current value Iq5 is not less than a predetermined threshold. When the foreign object detector 201 determines that the difference value between the acceleration current value Iq4 and the deceleration current value Iq5 is not less than the predetermined threshold, the foreign object detector 201 determines that the drum 3 contains an object that is as heavy as a child, and temporarily stops the operation of the washing machine 1.

After the operation of the washing machine 1 is temporarily stopped, the notifier 204 notifies the user that there is possibility that a child is inside the drum 3. As a notification method, the notifier 204 may be configured to send information that there is possibility that a child is inside the drum 3 to the communication terminal 30 connected to the washing machine 1 via the network. Otherwise, the notifier 204 may be configured to perform the notification by making a speaker (not illustrated) of the washing machine 1 produce a sound such as a buzzing noise, or by displaying the message or icon on the control panel 10. Incidentally, the predetermined threshold may be a value that is based on actually-measured data, and that makes it possible to detect that an object clearly greater than clothes is inside the drum 3 with the weight of a child taken into consideration.

On the other hand, when the foreign object detector 201 determines that the difference value between the acceleration current value Iq4 and the deceleration current value Iq5 is less than the predetermined threshold, the laundry amount detector 203 detects the laundry amount based on the difference value between the acceleration current value Iq4 and the deceleration current value Iq5.

The carrying out of the foreign object detection process and the laundry amount detection process in the right sequence as discussed above makes it possible to detect a foreign object and the laundry amount safely and appropriately.

Figure 7:
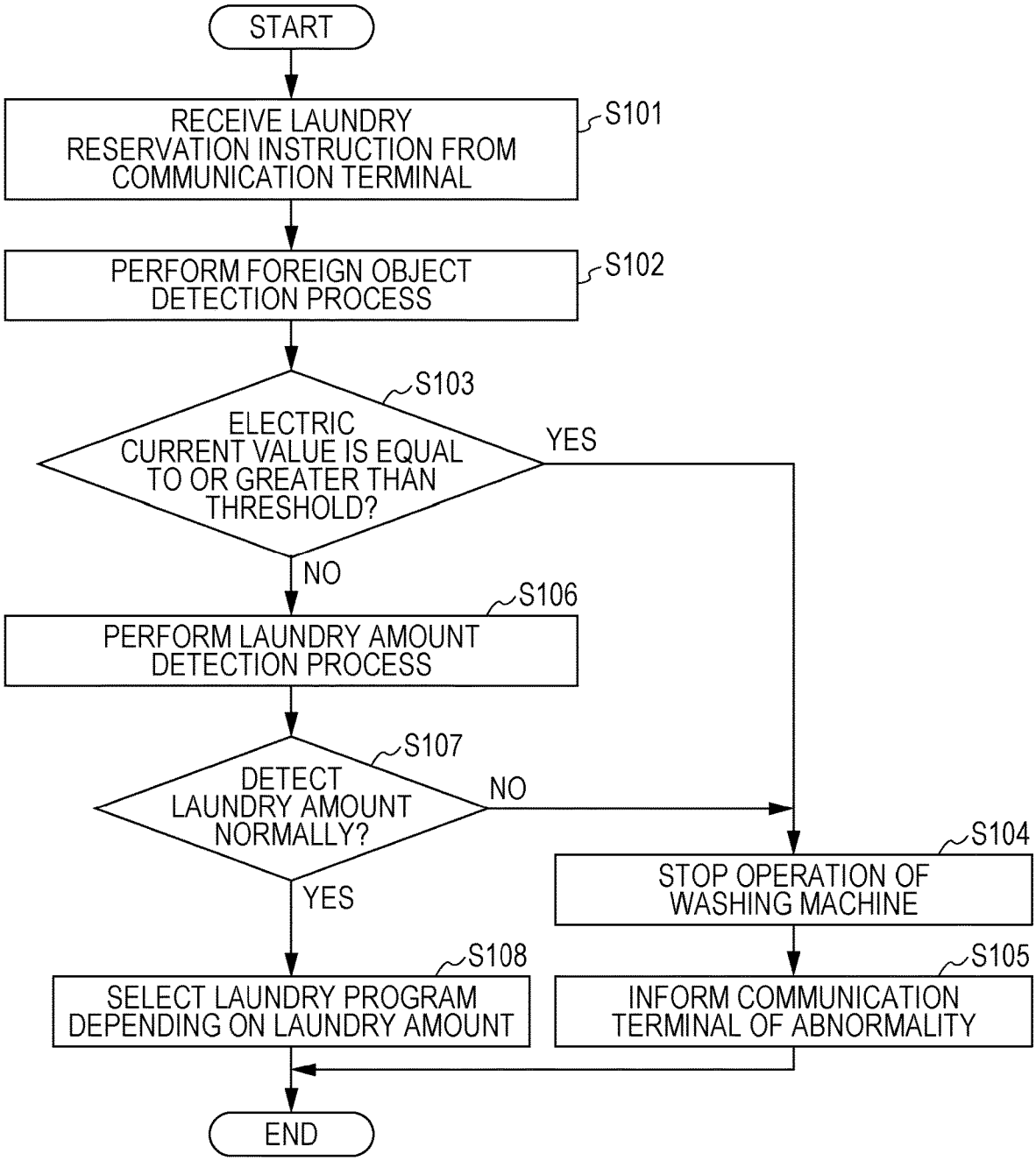
FIG. 7 is a flowchart illustrating an example of how the washing machine according to the first embodiment of the present disclosure works.

FIG. 7 is a flowchart illustrating an example of how the washing machine of the first embodiment of the present disclosure works.

First of all, the communication unit 24 receives a laundry reservation instruction from the communication terminal 30 (step S101). The communication unit 24 outputs the received laundry reservation instruction to the controller 20. The laundry reservation instruction includes, for example, time at which the washing machine is scheduled to start the laundry. The time at which the washing machine is scheduled to start the laundry may be shown as how many hours from now the washing machine is going to start the laundry.

Although the first embodiment is configured such that in step S101, the communication unit 24 receives the laundry reservation instruction to reserve the time at which to make the washing machine 1 start washing clothes, the present disclosure is not specifically limited to this configuration. The communication unit 24 may receive the laundry start instruction to make the washing machine 1 start washing clothes. The processes in step S102 and the ensuing steps may be performed once the communication unit 24 receives the laundry start instruction.

Next, the foreign object detector 201 performs the foreign object detection process of controlling the rotation of the motor 7 in order to rotate the drum 3 less than a half turn (step S102). The electric current measurement unit 11 measures the current electric value representing the electric current that flows in the motor 7.

Thereafter, the foreign object detector 201 determines whether the current electric value measured by the electric current measurement unit 11 is not less than the predetermined threshold (step S103). If the foreign object detector 201 determines that the measured electric current value is not less than the predetermined threshold (if YES in step 103), the stopper 202 stops the operation of the washing machine 1 (step S104).

Subsequently, the notifier 204 notifies the communication terminal 30 of the anomaly inside the washing tub via the communication unit 24 (step S105). The communication terminal 30 may be configured to, when notified of the anomaly, send the washing machine 1 a foreign object detection instruction to make the washing machine 1 again perform a foreign object detection process. The communication unit 24 may be configured to, after sending the communication terminal 30 the notification information, receive from the communication terminal 30 the foreign object detection instruction to make the foreign object detector 201 detect whether the drum 3 contains a foreign object. Once the communication unit 24 receives the foreign object detection instruction, the operation may return to the process of step S102, where the foreign object detector 201 again performs the foreign object detection process. In other words, the foreign object detector 201 may be configured to, after the communication unit 24 receives the foreign object detection instruction, control the rotation of the motor 7 in order to rotate the drum 3 less than a half turn, and again detect whether the drum 3 contains a foreign object based on the electric current value measured by the electric current measurement unit 11.

On the other hand, if the foreign object detector 201 determines that the detected electric current value is less than the predetermined threshold (if NO in step S103), the laundry amount detector 203 performs the laundry amount detection process of controlling the rotation of the motor 7 in order to rotate the drum 3 at the number of rotations for detecting the laundry amount (step S106). The electric current measurement unit 11 measures the electric current value representing the electric current that flows in the motor 7, and sends the detection result to the controller 20. The laundry amount detector 203 detects the laundry amount (the amount of clothes) based on the electric current value measured by the electric current measurement unit 11.

Next, the laundry amount detector 203 determines whether the laundry amount detector 203 has detected the laundry amount normally (step S107). If the laundry amount detector 203 determines that the laundry amount detector 203 has detected the laundry amount normally (if YES in step S107), the controller 20 selects a laundry program depending on the laundry amount detected by the laundry amount detector 203 (step S108). The laundry program covers, for example, the amount of water, a laundry time, a rising time, a spinning time that depend on the laundry amount. The controller 20 may be configured to, once selecting the laundry program, notify the selected laundry program to the communication terminal 30 via the communication unit 24.

Furthermore, the controller 20 stores the selected laundry program and the reserved time included in the laundry reservation instruction into the memory 21. When the current time reaches the reserved time stored in the memory 21, the controller 20 starts the laundry depending on the selected laundry program. It should be noted that, in a case where the communication unit 24 receives the laundry start instruction in step S101, the controller 20 accordingly starts the laundry depending on the selected laundry program.

On the other hand, if the laundry amount detector 203 determines that the laundry amount detector 203 has not detected the laundry amount normally (if NO in step S107), the stopper 202 stops the operation of the washing machine 1 (step S104).

Next, the notifier 204 notifies the communication terminal 30 of the anomaly inside the washing tub via the communication unit 24 (step S105).

As discussed above, even when the user cannot check whether a child is inside the washing tub 2 at the reserved laundry start time or at the laundry start time because the user is in a remote location, the first embodiment makes it possible for the washing machine 1 to safely detect whether a child is inside the drum 3, to continue the laundry in the case where the safety inside the drum 3 is secured, and to stop the laundry in the case where the inside of the drum 3 is anomalous. Because of the first embodiment, furthermore, even in a case where additional laundry is put into the drum 3, the washing machine 1 is capable of: detecting an increase in the laundry amount; and thereby proposing an appropriate laundry program to the user. Moreover, the control method of the first embodiment can detect whether a foreign object is inside the drum 3 at low costs, because the control method can use the conventional laundry amount detection technique and requires no additional detection device.

Second Embodiment

A configuration of the remote control system of a second embodiment is the same as that of the remote control system of the first embodiment. For this reason, descriptions for the configuration of the remote control system of the second embodiment will be omitted.

Figure 8:
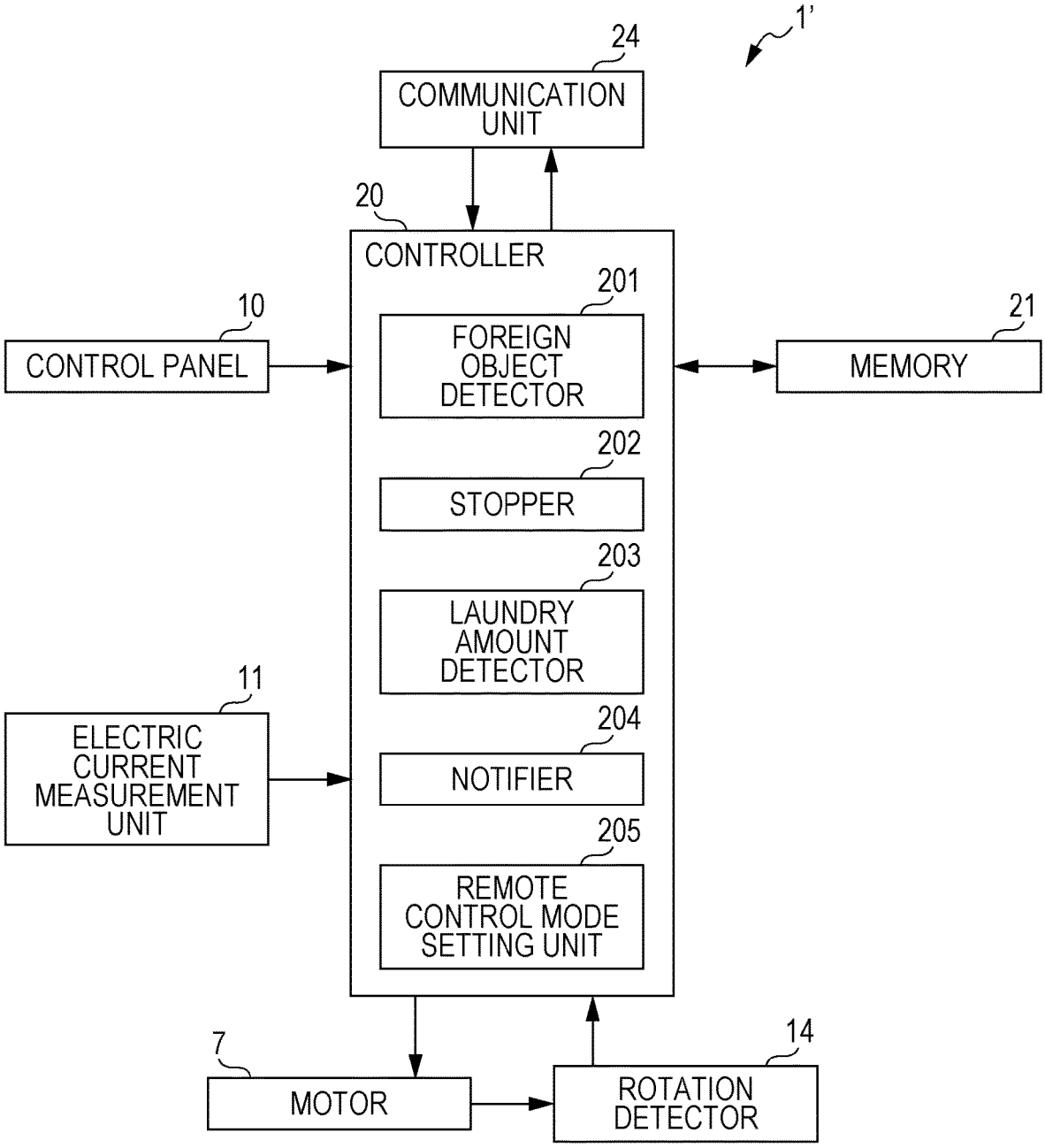
FIG. 8 is a block diagram illustrating a configuration of a washing machine according to a second embodiment of the present disclosure.

FIG. 8 is a block diagram illustrating a configuration of a washing machine according to the second embodiment of the present disclosure. It should be noted that the washing machine 1' is an example of the washer dryer machine.

The washing machine 1' includes the motor 7, the control panel 10, the rotation detector 14, the controller 20, the memory 21 and the communication unit 24. Incidentally, components of the second embodiment which are the same as those of the first embodiment will be denoted by the same reference signs, and descriptions for them will be omitted.

The controller 20 includes the foreign object detector 201, the stopper 202, the laundry amount detector 203, the notifier 204, and a remote control mode setting unit 205.

Before the washing machine 1' of the second embodiment is remotely controlled from the external communication terminal 30, the main body of the washing machine 1' needs to be set into a remote control mode. The remote control mode setting unit 205 sets the remote control mode to allow the communication terminal 30 connected to the washing machine 1' via the network to remotely control the washing machine 1'. For example, the remote control mode setting unit 205 sets the washing machine 1' into the remote control mode when multiple buttons included in the control panel 10 are pressed down at the same time.

While the washing machine 1' is set in the remote control mode, the communication terminal 30 can remotely control the washing machine 1'. While the washing machine 1' is not set in the remote control mode, the communication terminal 30 cannot remotely control the washing machine 1'. It should be noted that the second embodiment requires the remote control mode to be set directly into the main body of the washing machine 1', and does not allow the remote control mode to be set from the communication terminal 30.

From the communication terminal 30, the communication unit 24 receives a laundry reservation instruction to reserve time at which to make the washing machine 1' start washing clothes, or a laundry start instruction to make the washing machine 1' start washing clothes.

Once the remote control mode setting unit 205 sets the washing machine 1' into the remote control mode, the foreign object detector 201 controls the rotation of the motor 7 in order to rotate the drum 3 less than one turn, and obtains an electric current value measured by the electric current measurement unit 11 as a first electric current value, thus storing the obtained first electric current value into the memory 21. In a case where the communication unit 24 receives the laundry reservation instruction or the laundry start instruction, before the time at which to make the washing machine start washing the clothes is reserved, of before the washing machine starts washing the clothes, the foreign object detector 201 controls the rotation of the motor 7 in order to rotate the drum 3 less than one turn, and obtains an electric current value measured by the electric current measurement unit 11 as a second electric current value, thus calculating a difference between the obtained second electric current value and the first electric current value stored in the memory 21. Thereafter, the foreign object detector 201 determines whether the calculated difference is not greater than a predetermined threshold. If the foreign object detector 201 determines that the difference is greater than the predetermined threshold, the foreign object detector 201 determines that the drum 3 contains a foreign object. On the other hand, if the foreign object detector 201 determines that the difference is equal to or less than the predetermined threshold, the foreign object detector 201 determines that the drum 3 contains no foreign object.

In the second embodiment, when the washing machine is set into the remote control mode, the washing machine performs the foreign object detection process beforehand. Furthermore, before starting the laundry, the washing machine performs the foreign object detection process again, and compares the electric current measurement result obtained by the foreign object detection process that is performed for the second time and the electric current measurement result obtained by the foreign object detection process that is performed at the time when the remote control mode is set into the washing machine. In the above method, the electric current value that is measured at the time when the washing machine starts the laundry is compared with the electric current value that is actually measured immediately before, but not the predetermined threshold set beforehand. For this reason, this method can increase the accuracy in the foreign object detection.

Figure 9:
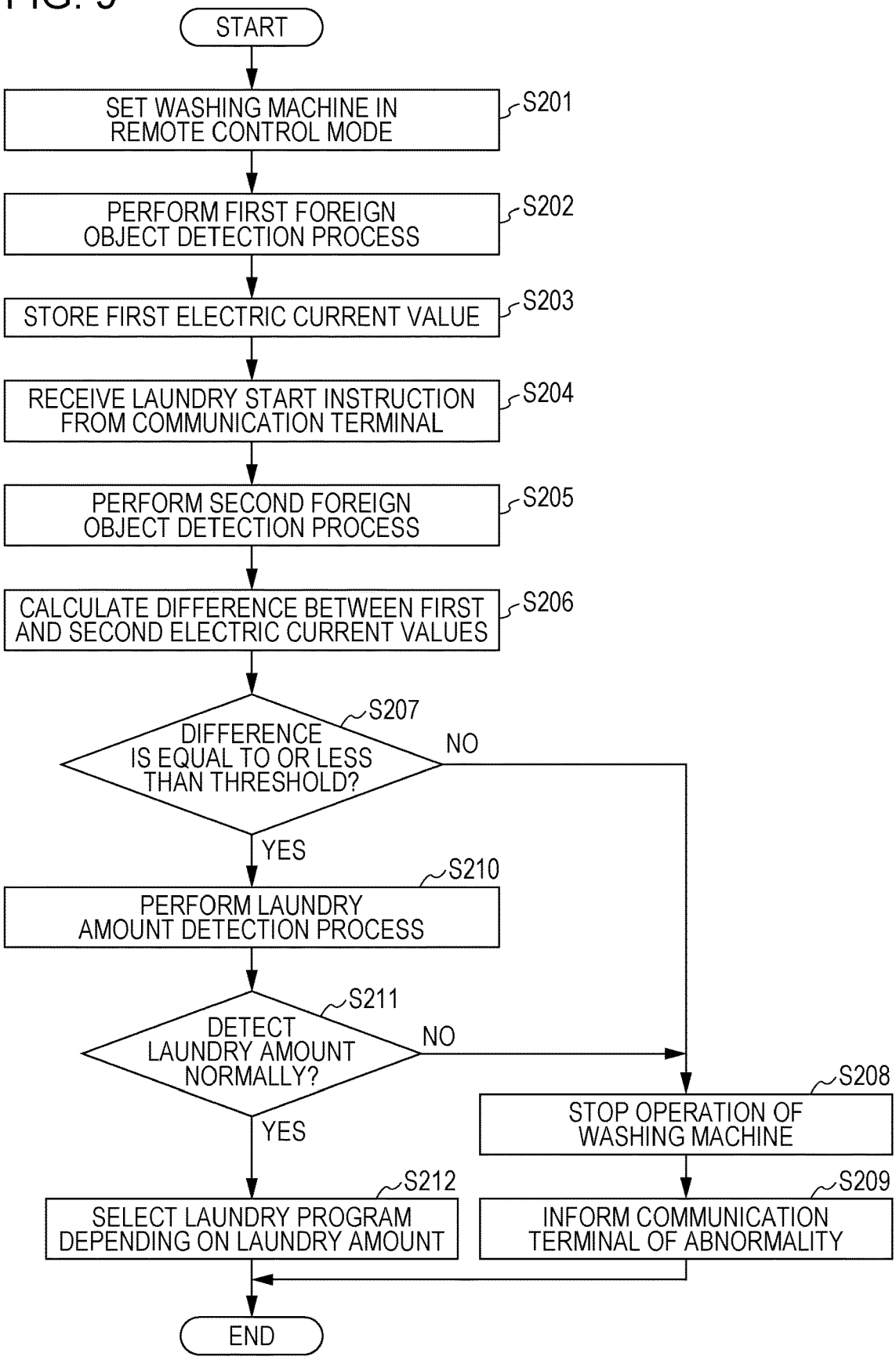
FIG. 9 is a flowchart illustrating an example of how the washing machine according to the second embodiment of the present disclosure works.

FIG. 9 is a flowchart illustrating an example of how the washing machine of the second embodiment of the present disclosure works.

First of all, the remote control mode setting unit 205 sets the washing machine 1' into the remote control mode (step S201). The control panel 10 of the washing machine 1' receives the user's manipulation thereon to set the washing machine 1' into the remote control mode. Once the control panel 10 receives the setting manipulation thereon, the remote control mode setting unit 205 shifts the washing machine 1' into the remote control mode.

Next, the foreign object detector 201 performs a first foreign object detection process of controlling the rotation of the motor 7 in order to rotate the drum 3 less than a half turn (step S202). The electric current measurement unit 11 measures the first electric current value representing the electric current that flows in the motor 7. It should be noted that the first foreign object detection process is the same as the foreign object detection process in the first embodiment.

Thereafter, the foreign object detector 201 stores into the memory 21 the first electric current value that is measured the electric current measurement unit 11 in the first foreign object detection process (step S203). The foreign object detector 201 may be configured to, in the first foreign object detection process, determines whether the measured first electric current value is not less than a predetermined threshold. The communication unit 204 may be configured to, when the foreign object detector 201 determines that the measured first electric current value is not less than the predetermined threshold, notify the communication terminal 30 of the anomaly inside the washing tub via the communication unit 24. Furthermore, the notifier 204 may be configured to perform the notification by making a speaker (not illustrated) of the washing machine 1' produce a sound such as a buzzing noise, or by displaying the message or icon on the control panel 10.

After that, from the communication terminal 30, the communication unit 24 receives a laundry start instruction to make the washing machine 1' start washing clothes (step S204). The communication unit 24 outputs the received laundry start instruction to the controller 20. Incidentally, the washing machine 1' may be configured: to go into a standby mode when the first electric current is stored in the memory 21, and stay in the standby mode until the communication unit 24 receives the laundry start instruction; and to terminate its operation when a predetermined time length (for example, 24 hours) has passed, or when the control panel 10 receives another manipulation thereon, or when the communication unit 24 receives another operation instruction from the communication terminal 30.

Once the communication unit 24 receives the laundry start instruction, the foreign object detector 201 performs a second foreign object detection process of controlling the rotation of the motor 7 in order to rotate the drum 3 less than a half turn (step S205). The electric current measurement unit 11 measures the second electric current value representing the electric current that flows in the motor 7. It should be noted that the second foreign object detection process is the same as the foreign object detection process in the first embodiment.

Next, the foreign object detector 201 calculates the difference between the second electric current value that is measured by the electric current measurement unit 11 in the second foreign object detection process and the first electric current value that is measured by the electric current measurement unit 11 in the first foreign object detection process and stored in the memory 21 (step S206).

After that, the foreign object detector 201 determines whether the difference between the first electric current value and the second electric current value is not greater than the threshold (step S207). If the difference is greater than the threshold (if NO in step S207), the stopper 202 stops the operation of the washing machine 1' (step S208).

Subsequently, the notifier 204 notifies the communication terminal 30 of the anomaly inside the washing tub via the communication unit 24 (step S209). The communication terminal 30 may be configured to, when notified of the anomaly, send the washing machine 1 a foreign object detection instruction to make the washing machine 1' again perform the second foreign object detection process. The communication unit 24 may be configured to, after sending the communication terminal 30 the notification information, receive from the communication terminal 30 the foreign object detection instruction to make the foreign object detector 201 detect whether the drum 3 contains a foreign object. Once the communication unit 24 receives the foreign object detection instruction, the operation may return to the process of step S205, where the foreign object detector 201 again performs the second foreign object detection process.

On the other hand, If the difference is equal to or less than the threshold (if YES in step S207), the laundry amount detector 203 performs a laundry amount detection process of controlling the rotation of the motor 7 in order to rotate the drum 3 at the number of rotations for detecting the laundry amount (step S210). The electric current measurement unit 11 measures the electric current value representing the electric current that flows in the motor 7, and sends the detection result to the controller 20. The laundry amount detector 203 detects the laundry amount (the amount of clothes) based on the electric current value measured by the electric current measurement unit 11.

Next, the laundry amount detector 203 determines whether the laundry amount detector 203 has detected the laundry amount normally (step S211). If the laundry amount detector 203 determines that the laundry amount detector 203 has detected the laundry amount normally (if YES in step S211), the controller 20 selects a laundry program depending on the laundry amount detected by the laundry amount detector 203 (step S212). The controller 20 may be configured to, when selecting the laundry program, notify the communication terminal 30 of the selected laundry program via the communication unit 24. Furthermore, the controller 20 starts the laundry in accordance with the selected laundry program.

On the other hand, if the laundry amount detector 203 determines that the laundry amount detector 203 has not detected the laundry amount normally (if NO in step S211), the stopper 202 stops the operation of the washing machine 1' (step S208).

Next, the notifier 204 notifies the communication terminal 30 of the anomaly inside the washing tub via the communication unit 24 (step S209).

As discussed above, even when the user cannot check whether a child is inside the washing tub 2 at the laundry start time because the user is in a remote location, the second embodiment makes it possible for the washing machine 1' to safely detect whether a child is inside the drum 3 with accuracy higher than in the first embodiment, to continue the laundry in the case where the safety inside the drum 3 is secured, and to stop the laundry in the case where the inside of the drum 3 is anomalous. Because of the second embodiment, furthermore, even in a case where additional laundry is put into the drum 3, the washing machine 1 is capable of: detecting an increase in the laundry amount; and thereby proposing an appropriate laundry program to the user.

Although the first and second embodiments have been discussed in which the washing machines 1, 1' that wash clothes are examples of the washer dryer machine, the present disclosure is not particularly limited to these embodiments. The washer dryer machine may be a dryer that dries clothes, or a washer dryer machine that washes and dries clothes. Otherwise, the dryer or the washer dryer machine may have the functions of the above-discussed washing machines 1, 1'.

Furthermore, although in the first and second embodiments, the foreign object detector 201 rotates the drum 3 less than a half turn in one direction, the present disclosure is not particularly limited to these embodiments. The foreign object detector 201 may be configured to rotate the drum 3 at 90 degrees from a reference position in one direction and then at 90 degrees from the reference position in the reverse direction.

The washer dryer machines and control method of the present disclosure are useful as washer dryer machines that wash or dry the object with improved safety, and a control method of detecting whether a drum contains a foreign object with improved safety.

What is claimed is:

1. A washer dryer machine that washes or dries an object, the washer dryer machine comprising:

a drum configured to rotate with the washing or drying object contained in the drum;

a motor configured to rotationally drive the drum;

an electric current measurer configured to measure an electric current value representing an electric current flowing in the motor;

a communicator configured to receive, from an external device, a laundry reservation instruction to reserve time at which to make the washer dryer machine start washing the object, or a laundry start instruction to make the washer dryer machine start washing the object; and a controller configured to:

set a remote control mode to allow an external device connected to the washer dryer machine via a network to remotely control the washer dryer machine, control first rotation of the motor to rotate the drum less than one turn when the remote control mode is set, measure first drive current during the first rotation by the electric current measurer, store the measured first drive current in a storage, control second rotation of the motor to rotate the drum less than one turn when the communicator receives the laundry reservation instruction or the laundry start instruction, before the reserve time at which to make the washer dryer machine start washing the object, or before the washer dryer machine starts washing the object, measure second drive current during the second rotation by the electric current measurer, calculate a difference between the measured second drive current and the first drive current stored in the storage, detect whether a foreign object having a mass greater than an expected mass of the washing or drying object is inside the drum based on the calculated difference, and stop the rotation of the motor when detecting the foreign object.

2. The washer dryer machine according to claim 1, wherein the controller configured to control the first rotation and the second rotation of the motor to rotate the drum less than a half turn.

3. The washer dryer machine according to claim 1, wherein the controller configured to control the first rotation and the second rotation of the motor to rotate the drum at a rotation speed that is slower than a rotation speed at which the drum rotates to detect an amount of the object.

4. The washer dryer machine according to claim 1, wherein in a case where the calculated difference is greater than a predetermined threshold, the controller is configured to detect the foreign object inside the drum.

5. The washer dryer machine according to claim 1, further comprising an output device that, in a case where the foreign object is detected, notifies that the drum contains the foreign object.

6. The washer dryer machine according to claim 1, wherein the controller is further configured to detect an amount of the object in accordance with the measured electric current value, and to detect whether the foreign object is inside the drum before detecting the amount of the object.

7. The washer dryer machine according to claim 1, wherein when the foreign object is detected, the communicator sends the external device notification information notifying that the drum contains the foreign object.

8. The washer dryer machine according to claim 7, wherein after sending the external device the notification information, the communicator receives from the external device a foreign object detection instruction to make the controller again detect whether the foreign object is inside the drum, and when the communicator receives the foreign object detection instruction, the controller configured to again control the second rotation of the motor to rotate the drum less than one turn, and in accordance with the second drive current again measured during the second rotation by the electric current measurer, to again detect whether the foreign object is inside the drum.

9. The washer dryer machine according to claim 1, wherein the drum has a rotation center axis extending in a horizontal direction, or a rotation center axis extending in an inclined direction that is inclined with respect to the horizontal direction.

10. A method of controlling a washer dryer machine that washes or dries an object, the washer dryer machine including:

a drum configured to rotate with the washing or drying object contained in the drum;

a motor configured to rotationally drive the drum;

a controller configured to control rotation of the motor;

an electric current measurer configured to measure an electric current value representing an electric current flowing in the motor; and a communicator configured to receive, from an external device, a laundry reservation instruction to reserve time at which to make the washer dryer machine start washing the object, or a laundry start instruction to make the washer dryer machine start washing the object, the method comprising:

setting a remote control mode to allow an external device connected to the washer dryer machine via a network to remotely control the washer dryer machine, controlling first rotation of the motor in order to rotate the drum less than one turn when the remote control mode is set, measuring first drive current during the first rotation by the electric current measurer, storing the measured first drive current in a storage, control second rotation of the motor to rotate the drum less than one turn when the communicator receives the laundry reservation instruction or the laundry start instruction, before the reserve time at which to make the washer dryer machine start washing the object, or before the washer dryer machine starts washing the object, measuring second drive current during the second rotation by the electric current measurer, calculating a difference between the measured second drive current and the first drive current stored in the storage, detecting whether a foreign object having a mass greater than an expected mass of the washing or drying object is inside the drum based on the calculated difference, and stopping the rotation of the motor when detecting the foreign object.

11. The method of controlling according to claim 10, wherein the first rotation and the second rotation of the motor are controlled to rotate the drum less than a half turn.

12. The method of controlling according to claim 10, further comprising controlling the first rotation and the second rotation of the motor to rotate the drum at a rotation speed that is slower than a rotation speed at which the drum rotates to detect an amount of the object.

13. The method of controlling in according to claim 10 wherein, in the detecting, the foreign object inside the drum is detected when the calculated difference is greater than a predetermined threshold.

14. The method of controlling according to claim 10, further comprising, when the foreign object is detected, outputting a notification signal indicating that the drum contains the foreign object.

15. The method of controlling according to claim 10, further comprising detecting an amount of the object in accordance with the measured electric current value and detecting whether the foreign object is inside the drum before detecting the amount of the object.

16. The method of controlling according to claim 10, the drum of the washer dryer machine having a rotation axis extending in a horizontal direction, or having a rotation axis extending in a direction inclined with respect to the horizontal direction.

* * * * *